United States Patent [19]

Musick

[11] 3,978,981

[45] Sept. 7, 1976

[54] LIGHTED CIGAR HOLDER

[76] Inventor: Francis S. Musick, 1169 A1A, Hillsboro Beach, Fla. 33062

[22] Filed: May 2, 1975

[21] Appl. No.: 573,815

[52] U.S. Cl. ..... 206/276; 131/256; 206/37

[51] Int. Cl.[2] ..... A24F 15/00; B65D 85/10; B65D 85/12

[58] Field of Search ..... 206/276, 270, 255, 265, 206/37, 496; 131/256

[56] References Cited

UNITED STATES PATENTS

| | | | |
|---|---|---|---|
| 812,064 | 2/1906 | Miller | 206/276 |
| 1,143,463 | 6/1915 | Terwilliger et al. | 206/270 |
| 1,204,178 | 7/1916 | Myers | 206/270 |
| 1,320,037 | 10/1919 | Davis | 206/276 |
| 1,485,267 | 2/1924 | Herks | 206/265 |
| 1,898,841 | 2/1933 | Klenk | 206/265 |
| 2,038,350 | 4/1936 | Farinella | 206/270 |
| 2,246,642 | 6/1941 | Stachowiak | 206/270 |
| 2,335,674 | 11/1943 | Horlick | 206/270 |

*Primary Examiner*—William T. Dixson, Jr.
*Attorney, Agent, or Firm*—Malin & Haley

[57] ABSTRACT

A device for retaining a lighted cigar, cigarette or the like which allows one to carry a lighted cigar or cigarette on his person, the device including a tubular shaped receptacle for receiving the lighted end of a cigar and a resilient retaining and heat dissipating means disposed within the receptacle body. The receptacle with the cigar received therein includes a venting means for dissipating heat and allowing continuous burning of the cigar. The device also includes a separate sanitary cap which covers the mouth-held end of the cigar whenever the cigar is being carried in a pocket or the like.

3 Claims, 3 Drawing Figures

LIGHTED CIGAR HOLDER

BACKGROUND OF THE INVENTION

This invention relates generally to a device which allows a person to carry a lighted cigar or cigarette, and more specifically to a cigar holder which allows a person to carry a lighted cigar in his pocket whenever he wishes to discontinue smoking. Because of the length of time required for smoking an entire conventional cigar, the cigar smoker sometimes finds it desirous to discontinue smoking prior to expending the entire cigar. However, extinguishment of the cigar leaves a foul taste in the cigar tobacco that is noticeable to a smoker if he relights the cigar after extinguishing it in an ashtray or the like. Several devices in the prior art show cigar and cigarette receptacles which are used to extinguish the device and include also portable ashtrays and the like. Again the purpose of these receptacles is extinguishment or the receipt of ashes rather than allowing for the holding of a lighted cigar. As is known, the lighted end of a cigar or cigarette is relatively quite hot such that any receptacle for receiving a lighted cigar or cigarette must dissipate a large quantity of heat if carried on a person in a pocket or the like. The instant invention provides a device which allows one to retain and carry a lighted cigar or cigarette in which the container will not extinguish the cigar. The device includes a vented receptacle having a heat dissipating means so that the exterior walls of the receptacle do not become heated.

BRIEF DESCRIPTION OF THE INVENTION

A device for retaining and carrying a lighted tobacco product, such as a cigar, on one's person comprising a tubular receptacle body sized to receive the lighted end of a cigar, a helical spring connected within said body and a plurality of thermally insulated spacers disposed about the interior wall surface of said body, said spacers being connected to one end of said spring. Covering one end of said body is a mesh venting screen while the opposite end of the body is open. A pocket clip may be attached to the outside wall of said tubular body. A conical shaped sanitary cap may be used in conjunction with the body to cover the mouth engaging end of the cigar. The helical spring functions to resiliently but firmly hold the cigar within the tubular body, and acts to center the lighted end of the cigar within the tubular body such that the ash and burning portion of the cigar will not contact the walls of the hollow body. The spring is constructed of a thermally conductive material, such as metal, which dissipates heat along the spring. The spring and receptacle body diameters are sized to provide an air space circumferentially about the cigar between the inside wall of the tubular body and the outside of the cigar such that with the open mesh top, the receptacle is vented to allow the cigar to continue burning. The plurality of thermal insulated spacers are disposed longitudinally on the inside wall of the tubular body and in one embodiment includes four spacers, each disposed 90° to the other. Thus the air space between the cigar and inner receptacle wall incorporates a 360° venting system which allows for dissipation of a large quantity of heat produced by a lighted cigar within the receptacle. With the separate receptacle and sanitary end cap, the device allows for the accommodation of lighted cigars regardless of length. The cap provides for sanitary retention in the pocket of the smoker as it prevents juices from being received against the pocket itself. The utilization of a helical spring which is tapered allows various diameters of cigars to be held firmly with the device.

In operation, the spring itself is the only element which contacts the hot ash of the lighted cigar allowing it to absorb heat. Heat is conducted along the spring toward the top of the receptacle adjacent the screen while the air flow caused from the venting around the cigar in the inner wall of the receptacle provides a chimmney effect which absorbs the heat from the spring and discharges it through the screen, keeping the exterior of the receptacle relatively cool for carrying in the pocket of the user.

It is an object of this invention to provide a device for retaining and carrying a lighted cigar.

It is another object of this invention to provide a lighted cigar carrier which will accommodate cigars of different diameters and length.

And yet still another object of this invention is to provide a lighted cigar carrier in which the cigar carrying receptacle exterior walls are kept relatively cool such that the receptacle may be carried within the pocket or on the person of the user.

But still yet another object of this invention is to provide a cigar receptacle which allows the user to retain a cigar that is lighted without extinguishing the cigar.

In accordance with these and other objects which will be apparent hereinafter, the instant invention will now be described with particular reference to the accompanying drawings.

PREFERRED EMBODIMENT OF THE INVENTION

Figure 1:
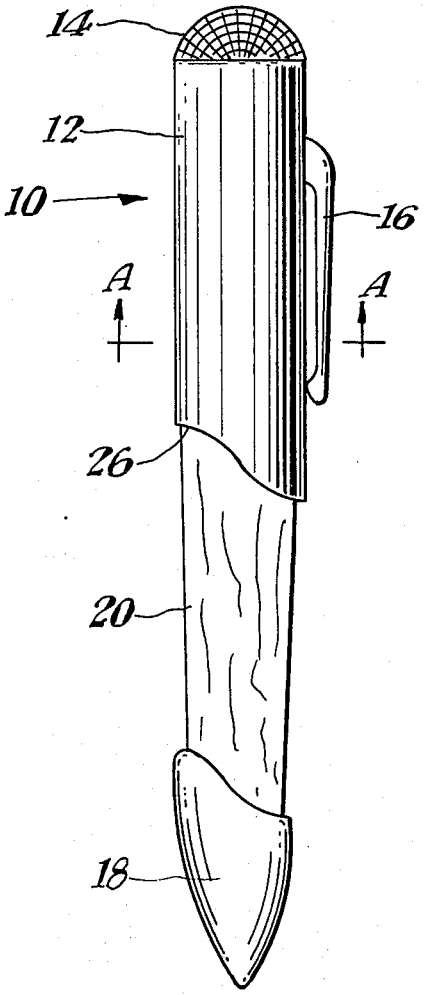
FIG. 1 is a side elevational view of the instant invention including a cigar retained therein.

Referring now to the drawings and especially FIG. 1, the instant invention is shown generally at 10 comprising a cigar receiving receptacle 12 which is essentially a tube made of any suitable material such as plastic or the like having affixed at one end an open mesh screen coupled across the tube upper end. The screen 14 is metal and may be shaped as a hemisphere and has a plurality of openings which allow smoke and heat to dissipate therethrough. The receptacle 12 also has a pocket clip 16 attached thereto which allows the receptacle body to be attached to a shirt pocket. The device is shown with a typical cigar 20 with its lighted end received into the receptacle body 12 with a separate sanitary cap 18 disposed at the opposite end. The sanitary cap 18 is utilized to cover the wet or moist end of the cigar that has been in the mouth of the user to prevent saliva or juices from staining the pocket of the user. The device is also sized to provide an air space 26 between the inner wall of the receptacle body 12 and the outside surface of the cigar 20.

Figure 2:
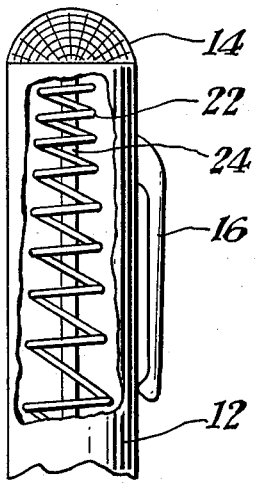
FIG. 2 is a side elevational view partially cut-away of a cigar receptacle as utilized in the instant invention.
Figure 3:
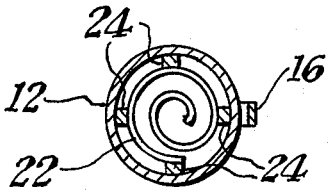
FIG. 3 is a section along lines A—A′ of FIG. 1.

FIG. 2 shows the receptacle body 12 with a conical helical shaped spring 22 which is thermally conductive connected on the inside of the cigar receptacle body 12 to the inner walls of the receptacle by a plurality of thermally insulated spacers 24 which are ribbed portions running in the longitudinal direction of the receptacle body along the inner walls. Thus the spring is connected across its maximum diameter to the spacing ribs which are separated at 90° intervals from each other around the interior of the receptacle. The spacers provide an air venting space between the largest diameter portion of the spring and the inside surface of the receptacle 12. FIG. 3 shows the ribbed spacers 24 connected to the bottom largest diameter portion of the spring 22. The size of the receptacle body and the spacers are shaped to accommodate cigars of different diameters, since the inner diameter of the spring decreases in the direction of the top of the receptacle. The spring serves many functions in the device which include the dissipation of heat along the spring while also acting to center the cigar within the receptacle body such that the cigar will not contact the inside walls of the receptacle itself. This allows the receptacle body to be made of a plastic or the like since the wall will not contact the burning end of the cigar. Finally the spring accommodates for cigars of different diameters.

Referring back to FIG. 1, to utilize the device the receptacle body 12 will be placed over the lighted end of the cigar (with the cigar gently inserted until it stops) and then rotated in either direction, firmly coupling the cigar to the receptacle body.

The sanitary cap 18 is then placed over the moist end of the cigar with the cigar then being placed in the pocket of the user using clip 16. When the device is not in use, the cap may be inserted into the receptacle body such that the device may be carried as a compact unit while the cap may be constructed to engage the open end of the device to be coupled thereto.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A lighted cigar holder for retaining and carrying a lighted cigar comprising:

a tubular cigar receptacle body, said body diameter being sized to receive an end longitudinal portion of a lighted cigar, said body having a first end and a second end, said first and second ends being open;

a mesh screen disposed over and connected to said first end of said receptacle body;

a helically shaped cigar receiving spring which is thermally conductive, said spring being connected inside said tubular body, said spring having a larger diameter sized to encompass the diameter of a cigar adjacent the second end of said tubular body and a smaller diameter at the first end, and a plurality of ribbed spacing means connected and disposed longitudinally along said interior receptacle body, said larger diameter spring portion conected to said ribbed means.

2. A lighted cigar holder, as in claim 1, including: a sanitary cap connectable to the moist end of a cigar.

3. A lighted cigar holder, as in claim 1, including: means attached to the outside of said receptacle body for clipping said body to a pocket.

* * * * *